US005497829A

United States Patent [19]

Rajkovich

[11] Patent Number: 5,497,829

[45] Date of Patent: Mar. 12, 1996

[54] EXPANSION FOAM BOREHOLE PLUG AND METHOD

[75] Inventor: Richard A. Rajkovich, Aurora, Minn.

[73] Assignee: Foam Concepts, Inc., Duluth, Minn.

[21] Appl. No.: 153,813

[22] Filed: Nov. 17, 1993

[51] Int. Cl.[6] ..... E21B 33/13

[52] U.S. Cl. ..... 166/285; 166/187; 166/192; 102/333

[58] Field of Search ..... 166/285, 292, 166/187, 192; 102/333; 206/221

[56] References Cited

U.S. PATENT DOCUMENTS

| | | | |
|---|---|---|---|
| 910,201 | 1/1909 | Jorgenson . | |
| 3,613,784 | 10/1971 | Bassani | 166/187 |
| 3,756,389 | 9/1973 | Firth | 206/47 A |
| 3,809,224 | 5/1974 | Greenwood | 206/219 |
| 3,837,279 | 9/1974 | Cooke, Jr. | 102/24 R |
| 4,052,939 | 7/1981 | Simmons et al. | 102/24 R |
| 4,280,943 | 7/1981 | Bivens et al. | 260/29.2 E |
| 4,487,129 | 12/1984 | Isaac | 102/313 |
| 4,492,165 | 1/1985 | Marz | 102/313 |
| 4,493,261 | 1/1985 | Simon et al. | 102/331 |
| 4,633,946 | 1/1987 | Jackson | 166/187 |
| 4,790,890 | 12/1988 | Miller | 199/2 |
| 4,846,278 | 7/1989 | Robbins | 166/286 |
| 4,913,233 | 4/1990 | Fitzgibbon, Jr. | 166/285 |
| 4,919,203 | 4/1990 | Fitzgibbon, Jr. | 166/187 |
| 5,000,261 | 3/1991 | Fitzgibbon, Jr. | 166/187 |
| 5,035,286 | 7/1991 | Fitzgibbon, Jr. | 166/187 |
| 5,273,110 | 12/1993 | Fitzgibbon, Jr. | 166/187 |
| 5,346,005 | 9/1994 | Robbins | 166/187 |

FOREIGN PATENT DOCUMENTS

| | | |
|---|---|---|
| 1210688 | 9/1986 | Canada . |
| 2060610 | 8/1992 | Canada . |

*Primary Examiner*—Terry Lee Melius

*Attorney, Agent, or Firm*—Merchant, Gould, Smith, Edell, Welter & Schmidt

[57] ABSTRACT

A borehole decking plug which is created by a self-expanding plastic foam. Two closed waterproof pouches, an inner pouch and an outer pouch, each contain a separate component of the foam. The inner pouch is contained within the outer pouch, and both are contained within a third open external pouch having a tether attachment. Upon breaking the inner pouch, the separate foam components combine within the outer pouch to form a complete expansion foam. The foam expands slowly enough to provide sufficient time for the device to be lowered via the tether down a borehole to a preselected position. Once in position, the expansion foam bursts the outer pouch and escapes upward through the external pouch to form a deck plug at the preselected position.

23 Claims, 9 Drawing Sheets

EXPANSION FOAM BOREHOLE PLUG AND METHOD

FIELD OF THE INVENTION

The present invention relates to expandable borehole plugs and to the fixing of such plugs within a borehole for placing explosives or stemming.

BACKGROUND OF THE INVENTION

Drilling and blasting operations are used for controlled rock removal in mining, road construction, tunnelling, and rock sculpturing. Strategically spaced holes are drilled into the rock, powder charges are placed in the holes, the holes are sealed by back-filling with loose rock or other "stemming" material, and the charges are detonated. Diagram FIG. 1 shows the cross section of a typical prepared basic blast hole configuration.

For some blasting situations it is desireable to use air decking, a technique which provides an air space between the powder charge and the stemming material, as typically shown in FIG. 2. The air space allows blasting forces to be exerted over a greater length of the drill hole while using a reduced powder charge. A plug is used to suspend the stemming material above the powder charge, thereby creating the air space. An ideal plug completely seals the hole to prevent gasses from pushing upwards or "rifling" out of the blast hole. This results in maximum force application to the rock surface within the blast chamber.

In some cases, desirable effects are obtained by using multiple powder charges in the same blast hole, separating the charges with multiple plugs as typically shown in FIG. 3. In others, it is desireable to blast the hole in sections starting at the top and working downward. For these situations, the hole must be plugged a certain distance from the top to allow for the upper section of rock to be blown away first. A positive seal is needed for these operations to ensure that the force of the blast does not push downward into the bottom of the hole. Sand is filled in on top of the plug and stemming material is back-filled on top of the powder to help divert the force of the blast outward, into the rock, as typically shown in FIG. 4.

Escaping gasses, blown upwards around blocking mechanisms and through stemming material during detonation, may reduce the effectiveness of blasting. The most effective air decking blocking mechanisms, or plugs, are therefore those which provide positive gas sealing capabilities.

Therefore, there is a need for a safe, easy to use, inexpensive way to provide an air-tight borehole seal for use in blasting applications.

SUMMARY OF THE INVENTION

The present application provides for a borehole decking plug which is created by a self-expanding plastic foam. Two closed waterproof pouches, an inner pouch and an outer pouch, each contain a separate component of the foam. The inner pouch is contained within the outer pouch, and both are contained within a third open external pouch having a tether attachment. Upon breaking the inner pouch, the separate foam components combine within the outer pouch to form a complete expansion foam. The foam expands slowly enough to provide sufficient time for the device to be lowered via the tether down a borehole to a preselected position. Once in position, the expansion foam bursts the outer pouch and escapes upward through the external pouch to form a deck plug at the preselected position.

DETAILED DESCRIPTION

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

The present invention provides for a borehole decking plug with the following advantages over prior art devices and methods:

1. The foam components are sealed so the operator is not subject to exposure.
2. The foam components are easily mixed inside a self-contained pouch.
3. Control of mixing is maintained with predetermined levels of components.
4. Reliability is improved by maintaining an accurate mix of components providing optimal foam creation.
5. Color coded foam components provide the operator with a visual reference of mixing.
6. The self-contained foam components reduce the amount of time required to mix and load.
7. Elimination of waste products such as mixing heads and syringes.
8. An external pouch which assists in creating adhesion of the deck plug to the walls of the borehole.
9. Elimination of metal parts that could create sparks.
10. Modifications that provide for underwater operation.

The present invention is useful in creating a borehole decking plug in many different types of blasting applications and configurations. FIGS. 1–4 show the context of the invention. The borehole decking plug of the present invention may be substituted for prior art plugs in the locations shown in the figures.

Figure 1:
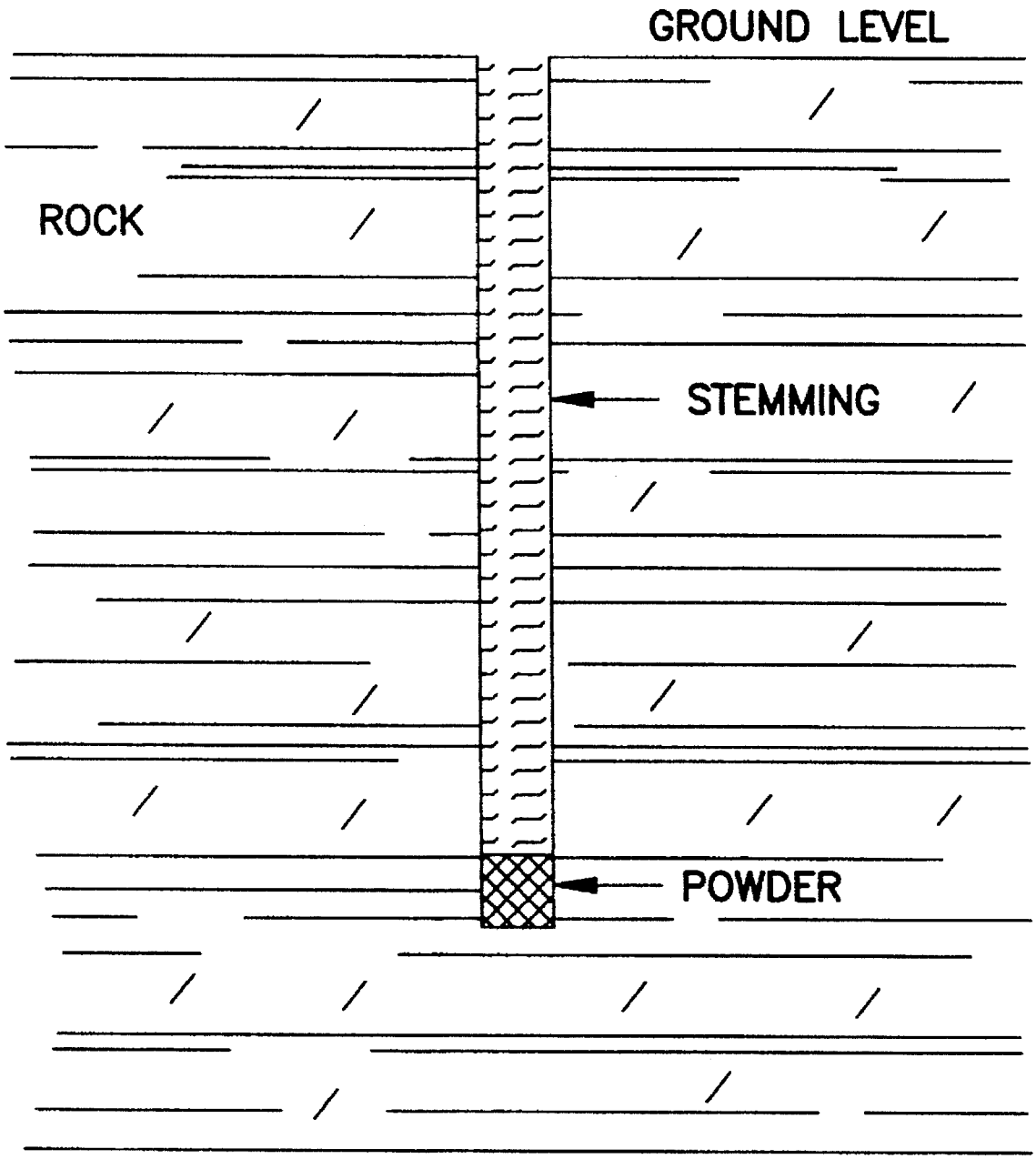
FIG. 1 is a cut-away view of a typical prepared basic blast hole configuration.

FIG. 1 shows a cut-away view of a typical prepared basic blast hole configuration. A powder charge is placed at the bottom of the borehole with stemming placed directly above the charge in order to control the effects of the blast. No borehole plug is used in this configuration.

Figure 2:
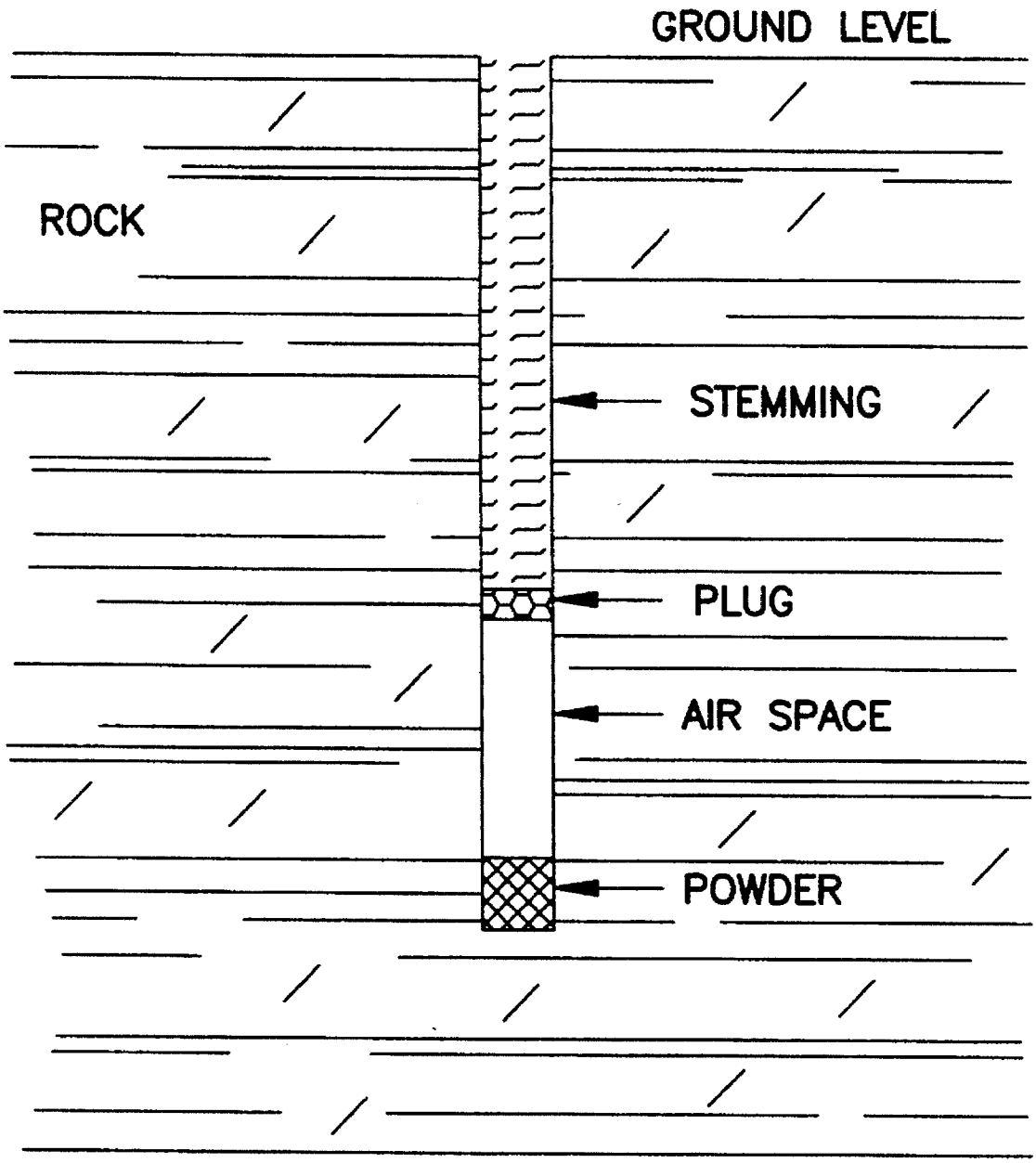
FIG. 2 is a cut-away view of a typical prepared basic blast hole configuration with air decking.

FIG. 2 shows a cut-away view of a typical prepared basic blast hole configuration with air decking. A powder charge is placed at the bottom of the borehole with a borehole plug placed at some distance above the charge, creating an air space between the charge and the plug. Stemming is placed directly above the plug in order to prevent rifling and control the effects of the blast.

Figure 3:
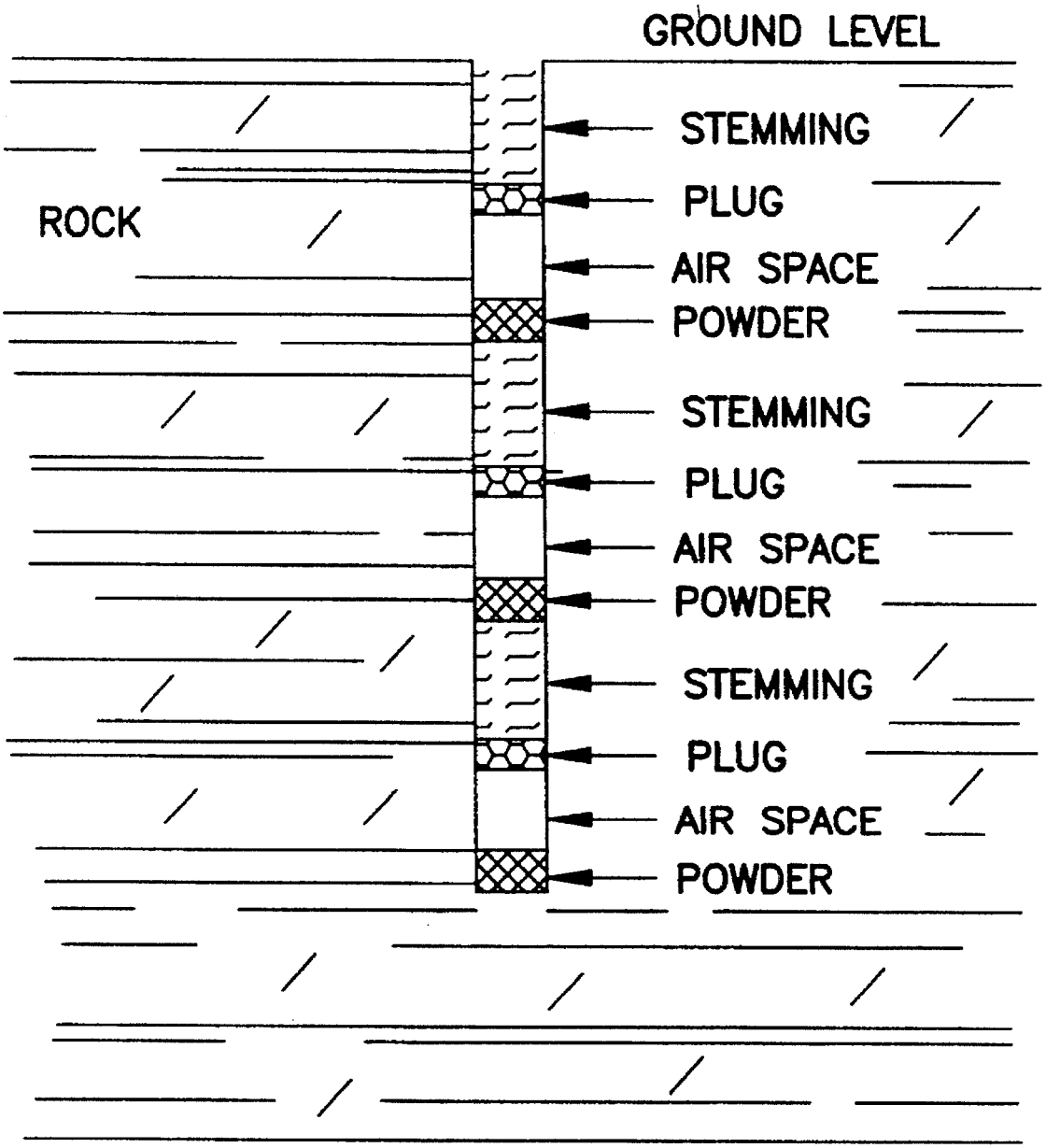
FIG. 3 is a cut-away view of a typical prepared basic blast hole configuration with multiple air decking.

FIG. 3 shows a cut-away view of a typical prepared basic blast hole configuration with multiple air decking. As in FIG. 2, a powder charge is placed at the bottom of the borehole with a borehole plug placed at some distance above the charge, creating an air space between the charge and the plug. Although not required, stemming may be optionally placed directly above the plug to a point below the top of the borehole. A second powder charge is placed on top of the optional stemming with a second borehole plug above it creating a second air space above the second charge. Stemming may then be optionally placed directly above the second plug, and further charges, plugs, and optional stemming may then be added as necessary.

Figure 4:
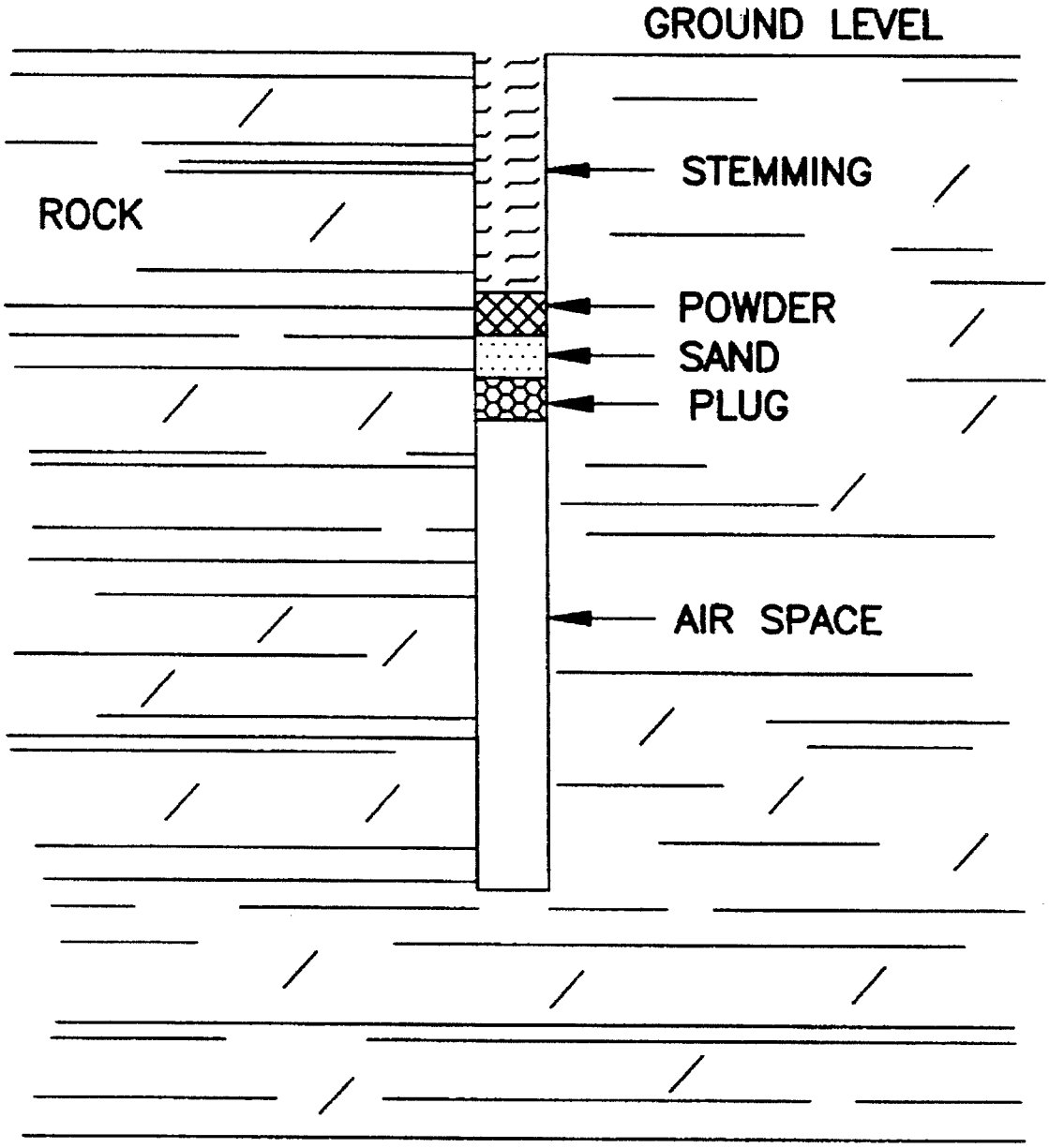
FIG. 4 is a cut-away view of a typical prepared basic blast hole configuration with a suspended charge.

FIG. 4 shows a cut-away view of a typical prepared basic blast hole configuration with a suspended charge. A borehole plug is placed at some distance above the bottom of the borehole, creating an air space in the lower portion of the borehole. Sand is placed directly above the plug, and a powder charge is placed directly on the sand. Stemming is then placed above the charge in order to control the effects of the blast.

Figure 8:
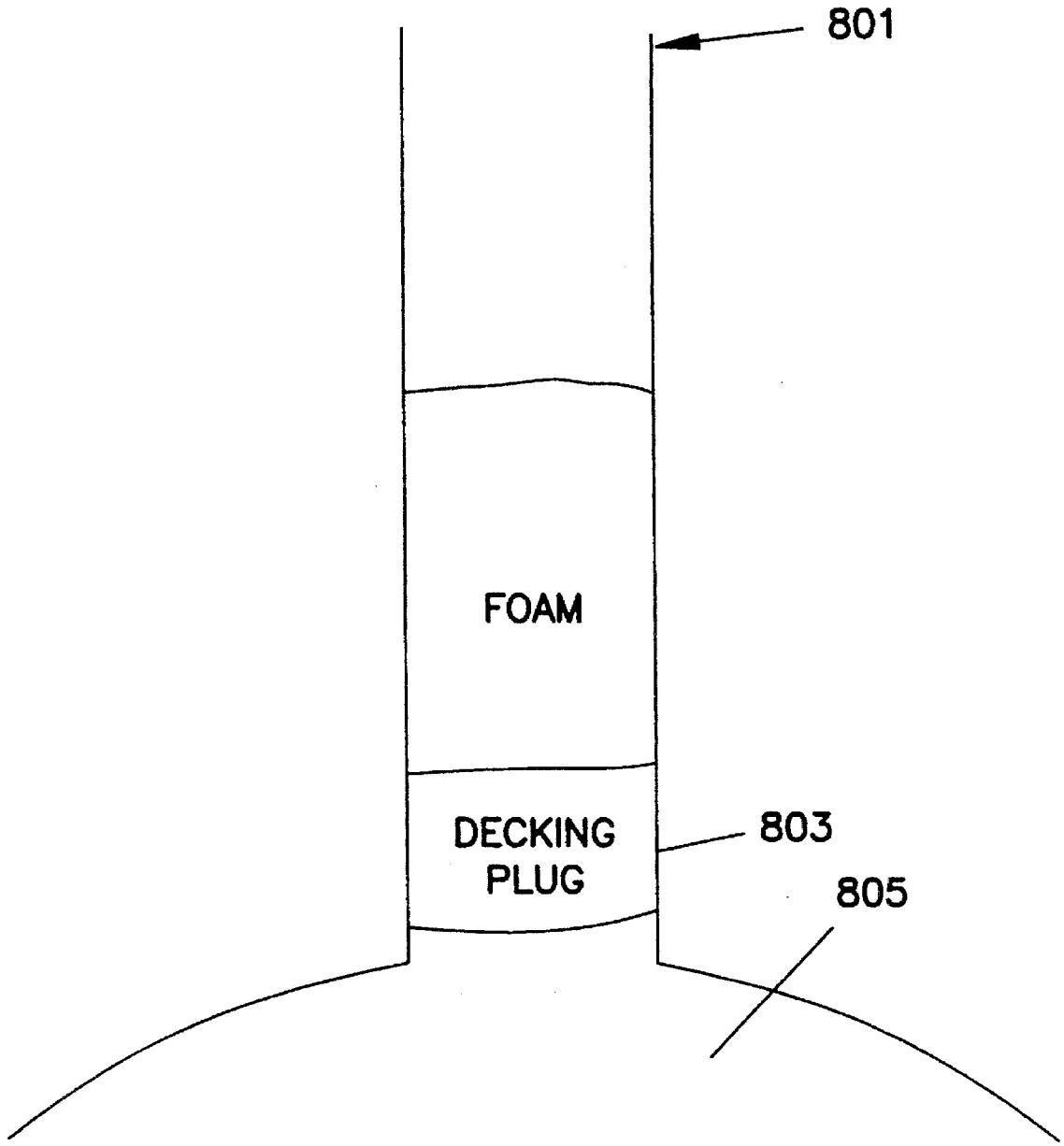
FIG. 8 is a cut-away view of a typical overhead borehole configuration.

FIG. 8 describes a cut-away view of a typical overhead borehole configuration. Typically used in underground mining applications, a borehole 801 is drilled upwards from a horizontal shaft of the mine 805. A pole or some other means is then normally used to place explosives up into the overhead borehole, and a decking plug 803 is typically placed at the bottom of the borehole to seal off the bottom of the borehole from the horizontal mine shaft.

Figure 9:
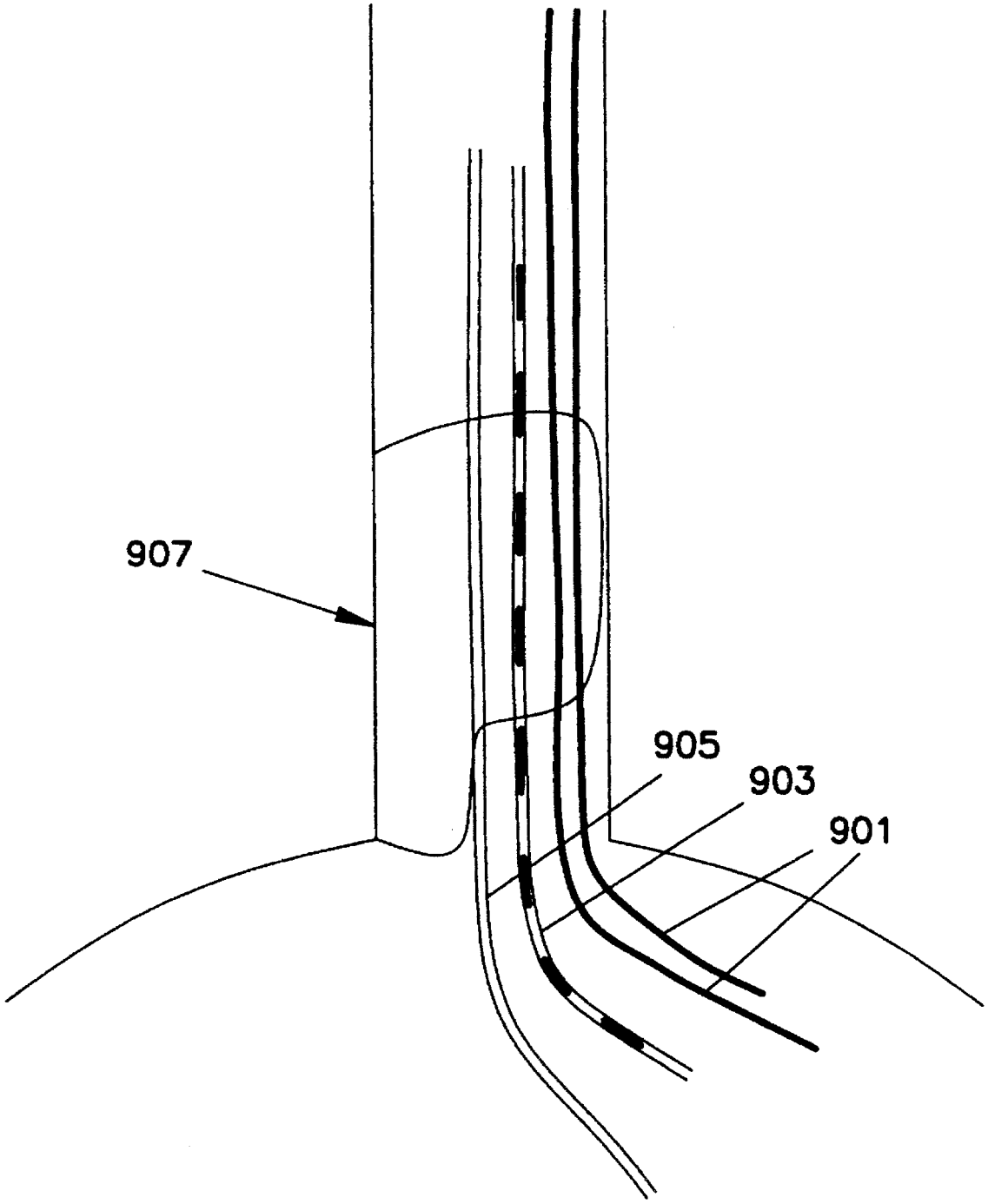
FIG. 9 is a cut-away view of a typical overhead borehole configuration for cable anchoring.

FIG. 9 describes a cut-away view of a typical overhead borehole configuration using cable anchoring. As with FIG. 8, this is typically used in underground mining applications to provide support for the ceiling of a horizontal mine shaft in order to prevent the collapse of the ceiling. Two overhead boreholes are normally drilled upwards some distance apart within a horizontal mine shaft. A number of cables 901 are typically inserted into the borehole, along with a grout tube 903 and a breather tube 905. A stem plug 907 is then usually placed at the bottom of the borehole to seal off the bottom of the borehole from the horizontal mine shaft. Grout is then typically pumped into the borehole through grout tube 903, and the air within the sealed borehole which is displaced by the grout is allowed to escape through the breather tube 905. The stem plug 907 prevents grout from falling out the bottom of the borehole into the horizontal mine shaft. Once the grout hardens, the cables 901 are firmly anchored within the borehole.

Figure 5:
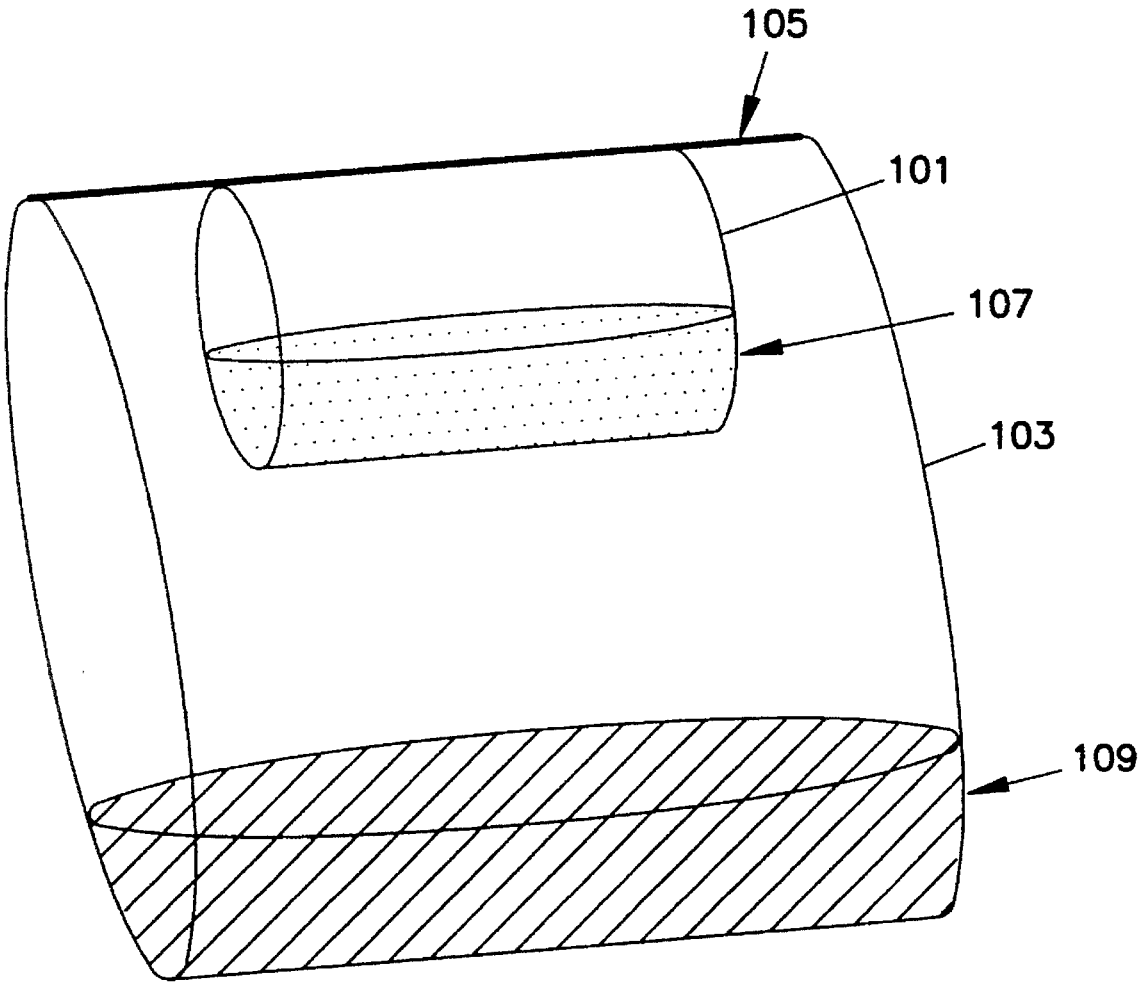
FIG. 5 is a perspective view showing an inner and an outer pouch of a typical borehole decking plug.

FIG. 5 is a perspective view of a borehole decking plug compatible with the present invention. An inner pouch 101 containing a first expansion foam component 107 is sealed inside of an outer pouch 103 containing a second expansion foam component. The inner pouch 101 and outer pouch are sealed along a seal 105. The pouches are typically made from tubular plastic film, are waterproof (liquid impervious), and are substantially clear so that their contents may be observed by an operator. The seal 105 joining the inner pouch 101 and outer pouch 103 allows the operator to easily grasp the inner pouch 101 within the outer pouch 103, preventing the inner pouch 101 from sliding around within the outer pouch 103 making it difficult to grasp. Further, the inner pouch 101 is typically made of thinner film than the outer pouch 103, such that the inner pouch 101 will break before the outer pouch 103 when mechanical pressure is applied.

Figure 6:
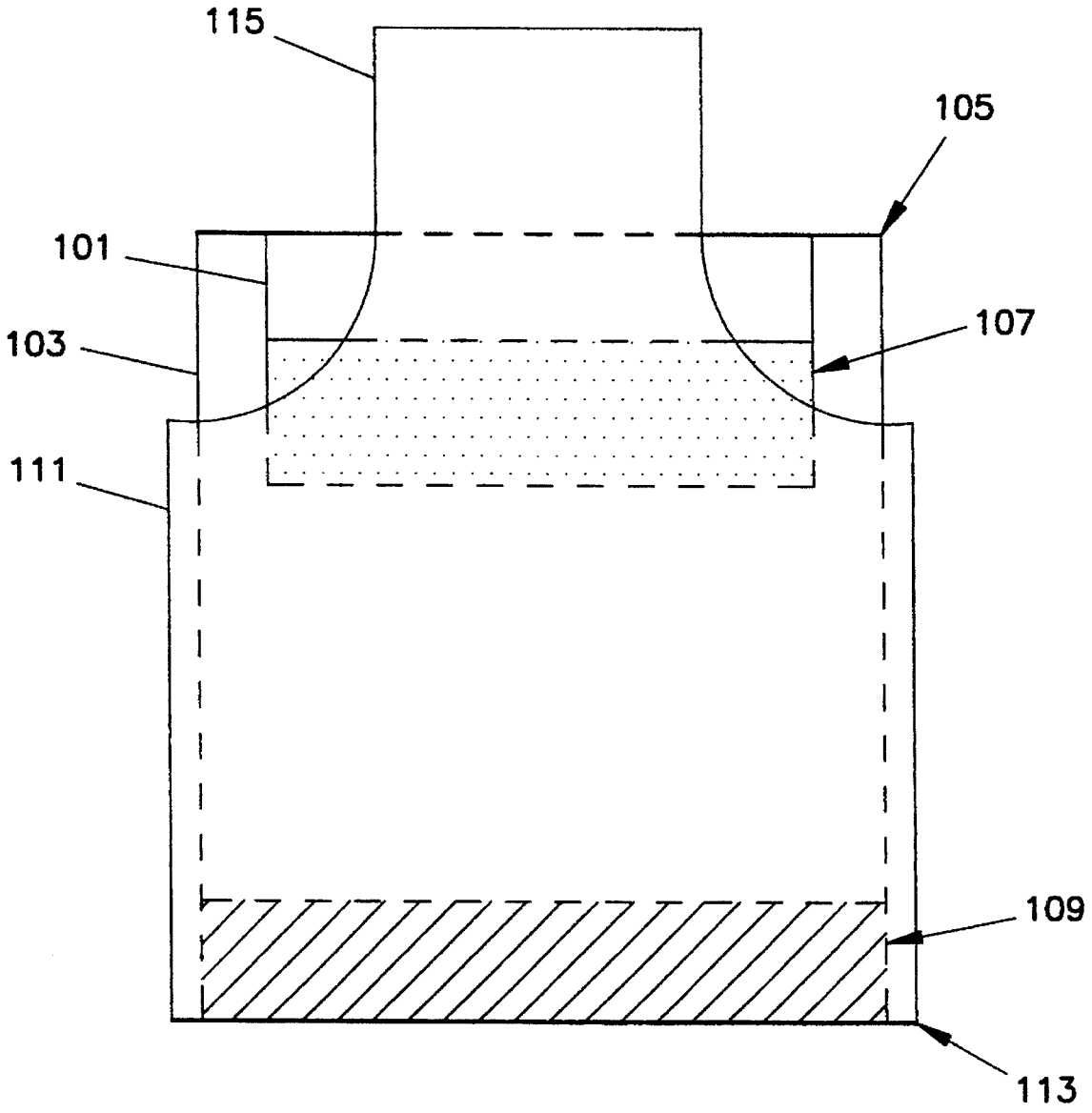
FIG. 6 is a plan view showing an inner pouch, an outer pouch, and an open external pouch of a typical borehole decking plug.

FIG. 6 shows how the inner pouch 101 and outer pouch 103 are held by an external pouch 111 ("diaper") which prevents the expanding foam from falling downward into the borehole when the outer pouch 103 bursts from foam expansion. The foam typically forms a decking plug with a positive seal by filling the external pouch 111 and expanding upward to adhere to the walls of the borehole. The external pouch 111 is typically made from plastic film, similar to the inner and outer pouches 101, 103, and is sealed around the outer pouch at 113. Additionally, the external pouch 111 normally provides a handle 115 to which a tether can be attached for suspending the device at a predetermined level within the borehole.

Figure 7:
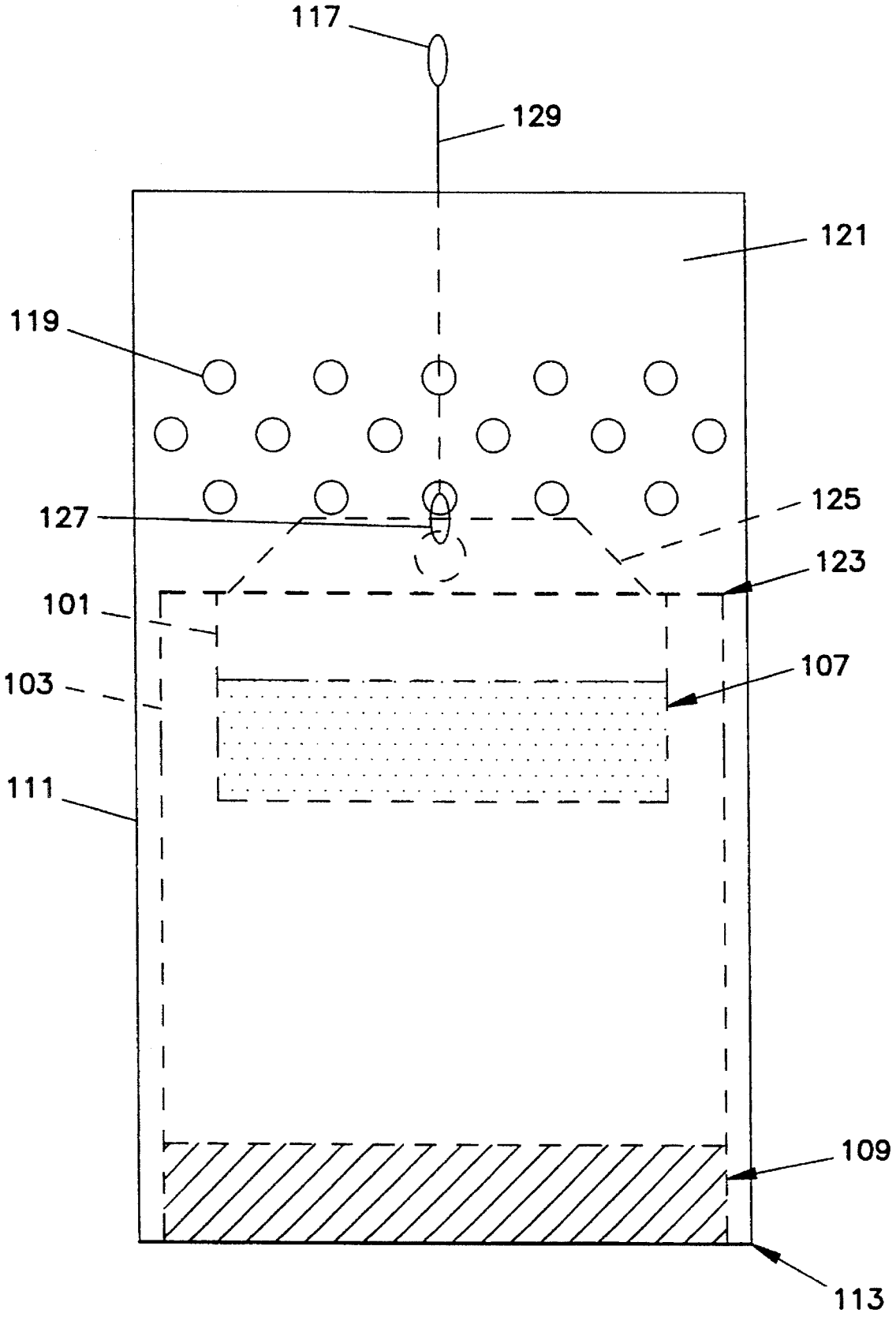
FIG. 7 is a plan view showing an inner pouch, an outer pouch, and an open external pouch of a typical borehole decking plug for underwater use.

FIG. 7 shows an alternative embodiment of the present invention for use with underwater blasting applications. The underwater embodiment is similar to that shown in FIG. 6, but typically uses a different structure for the external pouch 111. The external pouch 111 normally extends upward and is sealed at 121, forming a roof above the inner pouch 101 and outer pouch 103 containing expansion foam A and B components 107 and 109. The external pouch 111 typically contains a number of holes 119 located substantially between the mid-point and a point below the top edge of the external pouch 111, which allow water to be pushed out by the foam as it expands upward. An additional flap 125 is preferably sealed at 123 onto the inner pouch 101 and outer pouch 103 inside the external pouch 111. A cord 129 with a tether attachment 117 is normally fastened to the flap 125 at 127. This provides a means of attaching a tether for suspending the device at a certain level within the borehole. Once the expansion foam components are mixed, the device is typically lowered under water into the borehole. The device may optionally be weighted, such as with sand, in order to provide greater negative buoyancy. Once in position within the borehole, the expansion foam normally bursts the outer pouch 103 and seals the lower portion of the external pouch 111 to the walls of the borehole. As the foam continues to expand, it typically rises to the top of area 121 of the external pouch 111. As there are no holes in the very top portion of the external pouch 111, the foam expands outward, typically sealing to the walls of the shaft and pushing water from within the external pouch 111 through the open holes 119.

The preferred embodiment of the present invention contains no metal parts, such as air valves or fittings, that could create sparks and prematurely set off a charge.

The preferred two-part expansion foam typically comprises an isocyanate (A) compound and a polyol resin (B) compound. The preferred embodiment of the present invention uses foam FE 630-2.0 from Foam Enterprises, Inc., Minneapolis, Minn., but it will be recognized that other expansion foams with similar expansion characteristics, either polyurethane or non-polyurethane based, may be substituted for the FE 630-2.0 foam without loss of generality.

The A component acts as a catalyst and typically has a density of approximately 10.3 pounds per gallon (ppg). The B component may be of many different types of polyol resin blends, and typically has a density of approximately 10.2 ppg. The A component is typically visually dark in color, while the B component is typically visually more clear. It will be recognized that any number of chemically inert coloring agents may be added to either the A or B component in order to provide a stronger or different visual cue to aid an operator in mixing the components.

When combined, the A and B components typically expand to approximately 33 times the volume of their liquid state, resulting in a foam with a density of approximately 2.5–3.1 pounds per cubic foot (pcf) and a compressive strength of approximately 23 pounds per square inch (psi). In hot weather, at approximately 95° fahrenheit, the rise time is typically 10–20 seconds, the gel time is 30–55 seconds, and the tack free time is 50–80 seconds. In warm weather, at approximately 75° fahrenheit, the rise time is typically 20–30 seconds, the gel time is 80–95 seconds, and the tack free time is 100–125 seconds. In cold weather, the rise time, gel time, and tack free time are typically 20–30 seconds longer than the corresponding warm weather times. On average, a usable foam plug is formed 40–60 seconds after mixing the A and B components. It will be recognized that the foam density and reaction times are dependent on mix efficiency, temperature, and resultant foam thickness, and that the present invention accommodates a wide variation in these factors without loss of functionality. The chemistry of the foam may be adjusted for optimum performance, but a typical ratio of component A to component B of the foam is approximately 4 to 3. The amount of component A may be increased or decreased depending on the application. Increasing the proportion of component A to component B results in a harder foam, but generates more heat during the expansion phase of the foam. Decreasing the proportion of component A to component B normally results in a softer foam but with less heat generated. The ratio of component A to component B may be increased to substantially 3 to 2 on the upper range or decreased to substantially 3 to 7 on the lower range.

During the expansion phase, the foam typically remains warm to the touch externally, but may reach temperatures as high as 300° fahrenheit internally. This level of heating is usually undesirable in many blasting applications due to the volatility of the explosives involved. In order to reduce the internal heat generated by the expanding foam, a freon component such as 141B may be added to the B component. It will be recognized that other freon mixtures such as R11, or other cooling agents with the same chemical cooling properties as freon, may be substituted without loss of generality. Typically, the B component contains a ratio of polyol resin to 141B freon of 3.33–1.67 to 1 in order to reduce the internal heat generated by the expanding foam during the expansion phase. Increasing the percentage of freon results in a cooler foam during the expansion phase, but the resulting foam is proportionally less dense.

For a typical 7-inch diameter borehole, preferably 2.9 oz. of component A is combined with 7.5 oz. of component B, where the ratio of polyol resin to 141B freon is 2.0 to 1. Borehole diameters ranging from 2 to 24 inches may be accommodated by proportionally increasing or decreasing the amount of the foam components and pouch sizes as appropriate.

To create a borehole decking plug with the preferred embodiment of the present invention, an operator forcefully squeezes the inner pouch 101 within the outer pouch 103, either by hand, foot, or some other means. The seal 105, joining the inner pouch 101 in a fixed position within the outer pouch 103, allows the operator to easily grasp the inner pouch 101 within the outer pouch 103, eliminating the problem of the inner pouch 101 sliding around within the outer pouch 103 making it difficult to grasp. Because the inner pouch 101 is typically constructed of thinner material than the outer pouch 103, the inner pouch 101 preferably bursts before the outer pouch 103, thus allowing component A 107 of the inner pouch 101 to combine with component B 109 within the outer pouch 103. The device is next typically turned inside out so that the inner pouch 101 and outer pouch 103 are contained within the external pouch 111. The operator then attaches a line to the tether attachment 115 of the external pouch 111, and preferably kneads the outer pouch 103 to mix the foam components. As component A and component B are preferably different colors and the outer pouch is typically made of a substantially clear flexible plastic, the operator may visually verify that the A and B components are properly mixed by observing the final color of the mixed components.

Once the A and B components are mixed, the operator typically uses the line to lower the external pouch 111 containing the outer pouch 103 into the borehole to a preselected depth. The operator normally suspends the pouch from the line at the preselected depth until the foam expands and bursts the outer bag 103 but not the external pouch 111. The foam typically forms a decking plug with a positive seal by filling the external pouch and expanding upward to adhere to the walls of the borehole.

The present invention is to be limited only in accordance with the scope of the appended claims, since others skilled in the art may devise other embodiments still within the limits of the claims.

What is claimed is:

1. A borehole decking plug comprising:

an inner pouch and an outer pouch formed from a liquid-impervious flexible film material, the inner pouch containing a first expansion foam component, the outer pouch containing the inner pouch and a second expansion foam component;

a substantially liquid-impervious open external pouch made from a thin flexible film, the external pouch containing the outer pouch and comprising a top and a bottom edge, having at least one opening substantially near the top edge;

wherein upon breaking the inner pouch, the first and second expansion foam components combine within the outer pouch to form an expansion foam slowly enough to provide sufficient time for the device to be lowered down a borehole to a preselected position, the expansion foam bursting the outer pouch and escaping upward through the at least one opening in the external pouch to form the decking plug at the preselected position.

2. The borehole decking plug of claim 1 wherein the inner pouch is sealed in a fixed position within the outer pouch, sharing an edge forming a seam.

3. The borehole decking plug of claim 2 wherein the first expansion foam component substantially comprises an isocyanate compound and the second expansion foam component substantially comprises a polyol resin.

4. The borehole decking plug of claim 3 wherein the ratio of the first expansion foam component to the second expansion foam component is substantially 4 to 3.

5. The borehole decking plug of claim 3 wherein the second expansion foam component substantially comprises a polyol resin and freon mixture in combination.

6. The borehole decking plug of claim 5 wherein the ratio of polyol resin to freon mixture in the second expansion foam component is substantially 2 to 1.

7. The borehole decking plug of claim 1 wherein the thickness of the thin flexible film of the inner pouch is less than that of the thin flexible film of the outer pouch, such that when mechanical pressure is applied to the device the inner pouch breaks before the outer pouch.

8. The borehole decking plug of claim 1 wherein the outer pouch is joined internally to the inner pouch along at least one edge.

9. The borehole decking plug of claim 1 wherein the external pouch is joined to the outer pouch along at least one edge, forming a seam.

10. The borehold decking plug of claim 1 wherein the external pouch further comprises attachment means for facilitating the attachment of a tether.

11. The borehole decking plug of claim 1 adapted of underwater use, wherein the external pouch comprises a plurality of openings located substantially between the midpoint of the device and substantially below the top edge of the external pouch, the plurality of openings allowing for the escape of water as the expansion foam expands, the top edge of the external pouch remaining intact to provide a roof to trap the expansion foam as it expands upward.

12. The borehole decking plug of claim 9 further comprising attachment means joined externally to the outer pouch along at least one edge to facilitate the attachment of a tether.

13. The borehole decking plug of claim 1 wherein the inner pouch comprises a first volume substantially equal to the volume of the first expansion foam component, and wherein the outer pouch comprises a second volume substantially equal to the first volume plus the volume of the second expansion foam component.

14. A borehole decking plug comprising:

an inner pouch and an outer pouch formed from a liquid-impervious flexible film material, the inner pouch containing a first expansion foam component, the outer pouch containing the inner pouch and a second expansion foam component;

wherein upon breaking the inner pouch, the first and second expansion foam components combine within the outer pouch to form an expansion foam slowly enough to provide sufficient time for the device to be placed in a borehole at a preselected position, the expansion foam bursting the outer pouch and contacting the sides of the borehole to form the decking plug at the preselected position.

15. The borehole decking plug of claim 14 wherein the inner pouch is sealed in a fixed position within the outer pouch.

16. The borehole decking plug of claim 14 wherein the first expansion foam component substantially comprises an isocyanate compound and the second expansion foam component substantially comprises a polyol resin.

17. The borehole decking plug of claim 16 wherein the ratio of the first expansion foam component to the second expansion foam component is substantially 4 to 3.

18. The borehole decking plug of claim 16 wherein the second expansion foam component substantially comprises a polyol resin and freon mixture in combination.

19. The borehole decking plug of claim 18 wherein the ratio of polyol resin to freon mixture in the second expansion foam component is substantially 2 to 1.

20. The borehole decking plug of claim 14 wherein the thickness of the thin flexible film of the inner pouch is less than that of the thin flexible film of the outer pouch, such that when mechanical pressure is applied to the device the inner pouch breaks before the outer pouch.

21. The borehole decking plug of claim 14 wherein the outer pouch is joined internally to the inner pouch long at least one edge.

22. The borehole decking plug of claim 14 wherein the outer pouch further comprises attachment means to facilitate the attachment of a tether.

23. The borehole decking plug of claim 14 wherein the inner pouch comprises a first volume substantially equal to the volume of the first expansion foam component, and wherein the outer pouch comprises a second volume substantially equal to the first volume plus the volume of the second expansion foam component.

* * * * *

UNITED STATES PATENT AND TRADEMARK OFFICE

CERTIFICATE OF CORRECTION

PATENT NO. : 5,497,829

DATED : March 12, 1996

INVENTOR(S) : Rajkovich

It is certified that error appears in the above-indentified patent and that said Letters Patent is hereby corrected as shown below:

Claim 1, Column 6, line 32, insert --unvented-- after "an" and before "inner".

Claim 1, Column 6, line 32, insert --unvented-- after second "an" and before "outer".

Claim 11, Column 7, line 15, "of" (second occurrence) should read --for--.

Claim 21, Column 8, line 29, "long" should read --along--.

Signed and Sealed this

Twenty-sixth Day of November 1996

Bruce Lehman

*Attest:*

BRUCE LEHMAN

*Attesting Officer*

*Commissioner of Patents and Trademarks*